US005677016A

United States Patent [19]

Ferraiolo

[11] Patent Number: 5,677,016

[45] Date of Patent: Oct. 14, 1997

[54] FOLDABLE MULTICELLULAR STRUCTURE FOR RAPID INTERVENTION WORKS

[75] Inventor: Francesco Ferraiolo, Ca' de' Fabbri, Italy

[73] Assignee: Officine Maccaferri S.p.A., Bologna, Italy

[21] Appl. No.: 530,758

[22] Filed: Sep. 19, 1995

[30] Foreign Application Priority Data

Sep. 19, 1994 [IT] Italy ..... B094U0160

[51] Int. Cl.[6] ..... B32B 3/12

[52] U.S. Cl. ..... 428/12; 428/116; 428/122; 442/10

[58] Field of Search ..... 428/116, 122, 428/256, 12; 442/10

[56] References Cited

U.S. PATENT DOCUMENTS

| | | | |
|---|---|---|---|
| 4,011,728 | 3/1977 | Turzillo | 428/256 X |
| 4,572,705 | 2/1986 | Vignon et al. | 428/116 X |
| 4,699,836 | 10/1987 | Fearon et al. | 428/116 X |
| 5,132,156 | 7/1992 | Trassare, Jr. et al. | 428/116 |
| 5,175,041 | 12/1992 | Webb et al. | 428/116 |
| 5,466,211 | 11/1995 | Komarek et al. | 428/116 X |

FOREIGN PATENT DOCUMENTS

| | | | |
|---|---|---|---|
| 845863 | 8/1960 | United Kingdom | 428/256 |
| 2229204 | 9/1990 | United Kingdom . | |
| WO9012160 | 10/1990 | WIPO . | |

*Primary Examiner*—Henry F. Epstein

*Attorney, Agent, or Firm*—Sughrue, Mion, Zinn, Macpeak, and Seas

[57] ABSTRACT

A foldable multicellular structure for rapid intervention works comprises two side flanks, two end walls articulated to the side flanks, and a plurality of intermediate dividing walls which are also articulated to the side flanks and are spaced apart from one another by constant predetermined distances. The side flanks are formed by a plurality of basic component parts which are articulated to one another along a vertical side while the end walls and the dividing walls are each formed by a single component part. The component parts are produced from panels of netting, preferably metal netting, and are covered on one face by one or more sheets of material that is more close-meshed than the netting and is preferably a geotextile. The multicellular structure can be folded in a bellows-like manner after being flattened so that it has a reduced space requirement irrespective of the length of the structure in its open and erected configuration.

5 Claims, 3 Drawing Sheets

FOLDABLE MULTICELLULAR STRUCTURE FOR RAPID INTERVENTION WORKS

BACKGROUND OF THE INVENTION

The present innovation relates to a foldable multicellular structure which can be used in particular for rapid intervention works in which it is necessary to construct or erect barriers, embankments, dams and the like rapidly.

It has been known for some time to use substantially parallele-pipedal cage-like structures of metal netting which are transported to a place in which it is necessary to set up containment or protective works which are then filled with stones or the like. Such cage-like structures often have an internal covering formed by one or more sheets, generally a layer of geotextile, having the two-fold aim of enabling the cage-like structure also to be filled with stones or earth having particle sizes less than the meshes of the metal netting and of enabling water to drain out of the structure.

Basically, a structure of the known type comprises two side flanks, two end walls articulated to the side flanks, and a plurality of intermediate dividing walls articulated to the side flanks, said side flanks, end walls and dividing walls being formed by a netting.

When such structures are used for rapid intervention works, it is often necessary to transport very large numbers of cage-like structures to the place of final use as rapidly as possible in order to deal with events of immediate danger, such as, for example, floods, landslides, and, generally, for the defence of inhabited establishments or production installations. In such emergency conditions, the means of transport available are sometimes not specifically adapted to the transport of loads of exceptional size or weight. In addition, the personnel available at the site where the cage-like structures are used are often inexpert in the techniques of setting up containment works using such cage-like structures.

SUMMARY OF THE INVENTION

The aim of the present innovation is therefore to provide a structure of the above type which is simple to use and can be manufactured in sizes such that it can be readily transported also by improvised means of transport, or at any rate means of transport not specifically adapted for the purpose.

This aim is achieved by means of a multicellular structure of the above type, characterised in that the side flanks are formed by a plurality of component parts articulated to one another along a vertical side, the end walls and the dividing walls each being formed by a component part.

One advantage of the present innovation is that it provides a structure of the type indicated above which, if necessary, can be readily removed without requiring special equipment or expert operators.

Another advantage of the present innovation is that the structure indicated above can be rapidly assembled as required in accordance with widely variable dimensions but without it being necessary to have a wide variety of component parts available in store.

BRIEF DESCRIPTION OF THE DRAWINGS

Other characteristics and advantages will become clear from the following detailed description of a preferred embodiment which is given with reference to the appended drawings which are provided purely by way of non-limiting example and in which.

DETAILED DESCRIPTION OF THE INVENTION

Referring now to the Figures, a basic generic component part for the construction of structures according to the present innovation is generally indicated 1. This component part 1 comprises a substantially square or rectangular panel of netting, preferably produced from metal, on the vertical sides 1*a* of which reinforcing structures 2, for example metal rods or bars, are secured by known methods, such as clamping, welding, binding and the like.

Figure 1:
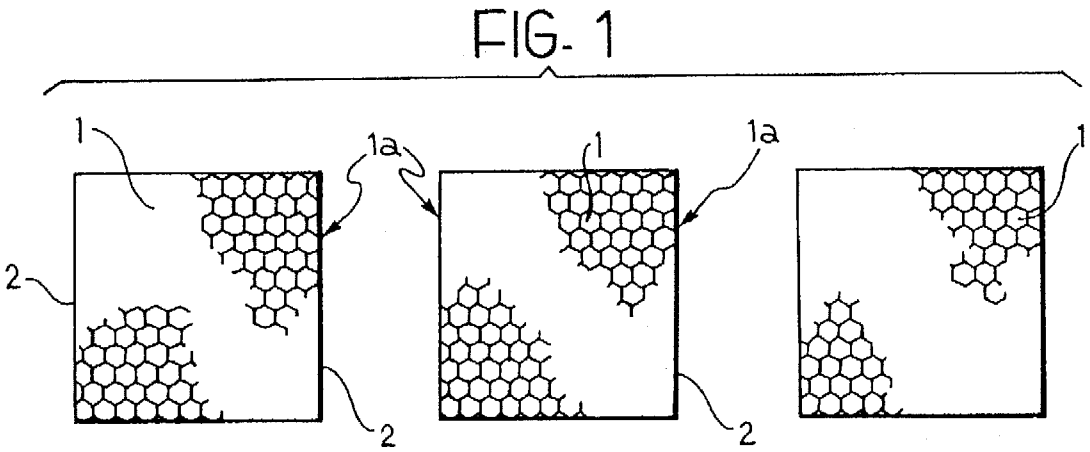
FIG. 1 is a front view of a group of basic component parts of the present innovation.
Figure 2:
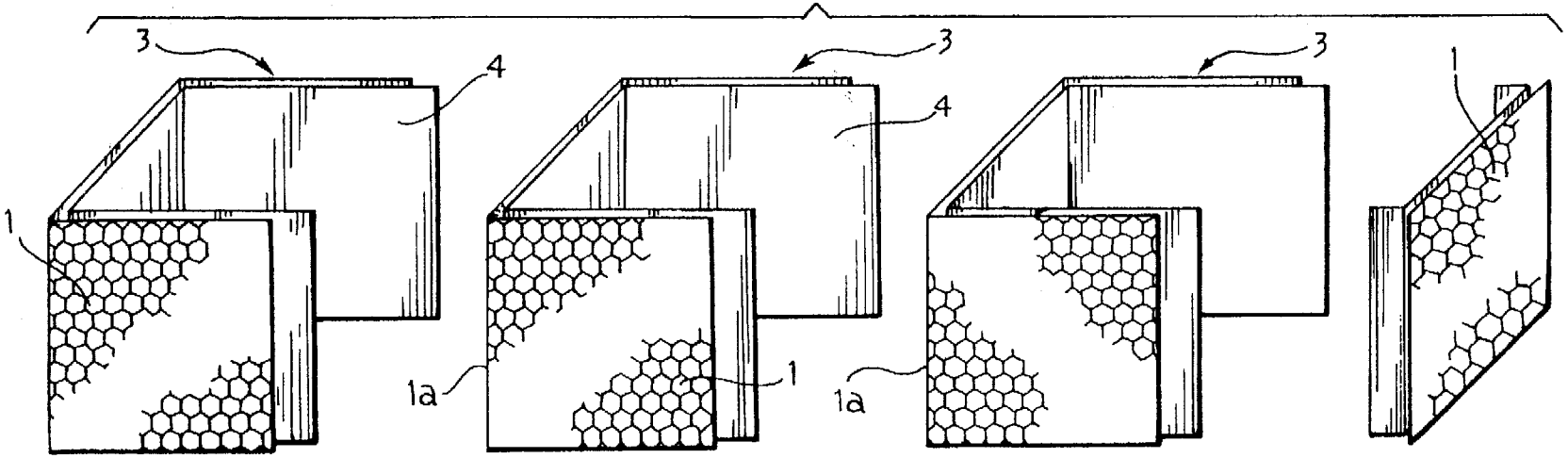
FIG. 2 is a perspective view of basic sub-groups for the formation of a multicellular structure according to the present innovation.

Three component parts 1 are then secured in such a manner that they are articulated to one another along the vertical sides 1*a* in order to form C-shaped sub-groups 3, as illustrated in FIG. 2. A continuous sheet of geotextile material 4 is fastened to the component parts 1 so that it covers the internal surface of the C-shaped sub-group.

Figure 3:
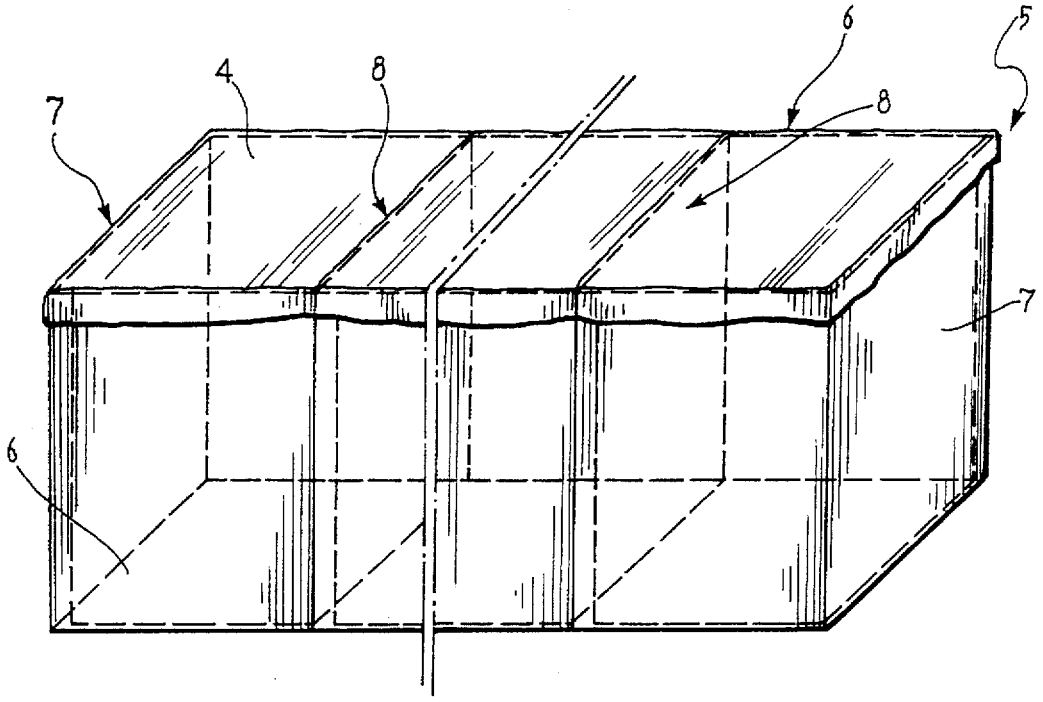
FIG. 3 is a perspective view of a structure according to the present innovation in assembled form.

The C-shaped sub-groups 3 are then secured in cascade manner and so that they are articulated to one another, and are closed at the end by another component part 1, which is also covered with a geotextile sheet, in order to form a multicellular structure 5, illustrated in FIG. 3, having a desired length, which is a multiple of the width of each component part 1, and a predetermined width equal to the width of each component part 1. The multicellular structure 5 is thus formed by two side panels which are generally indicated 6 and are formed by a plurality of component parts 1 which are articulated to one another, by two end panels 7 articulated to the side panels 6, and by a plurality of separating panels 8 which are parallel to the end panels 7 and are articulated to the side panels 6 at predetermined distances equal to the width of each component part 1. The assembly of panels 6, 7, 8 defines a plurality of compartments, each of which is completely covered inside by a layer of geotextile 4.

In this specification and in the appended claims, the term "covered inside" of the preceding sentence is to be intended in a broad sense. That is, the geotextile or—generally speaking—the at least one layer of close-meshed material allows the retention of the filling material inside the compartments even if the geotextile is not literally placed inside them, as it is the case, for example, of the layers which result applied to only one side of the separating panels 8 of the assembled structure shown in the appended drawings.

Figure 4:
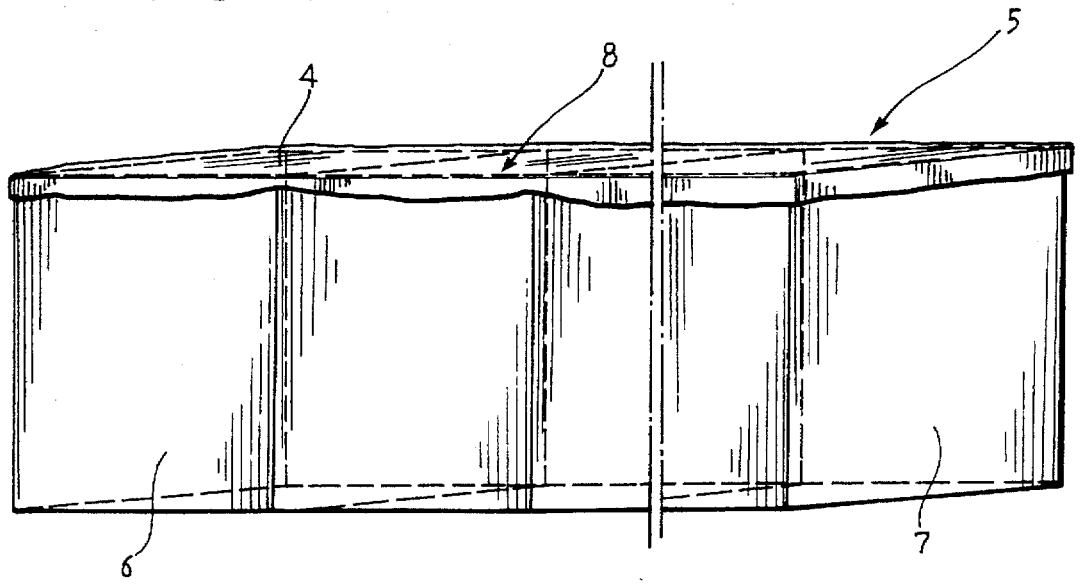
FIG. 4 is a perspective view of the structure of FIG. 3 partially folded.

In order to reduce the space requirement of the multicellular structure 5, especially if it is of substantial length, it is first of all flattened by bringing each of the two end panels 7 into contact with a corresponding side panel 6, as illustrated in FIG. 4.

Figure 5:
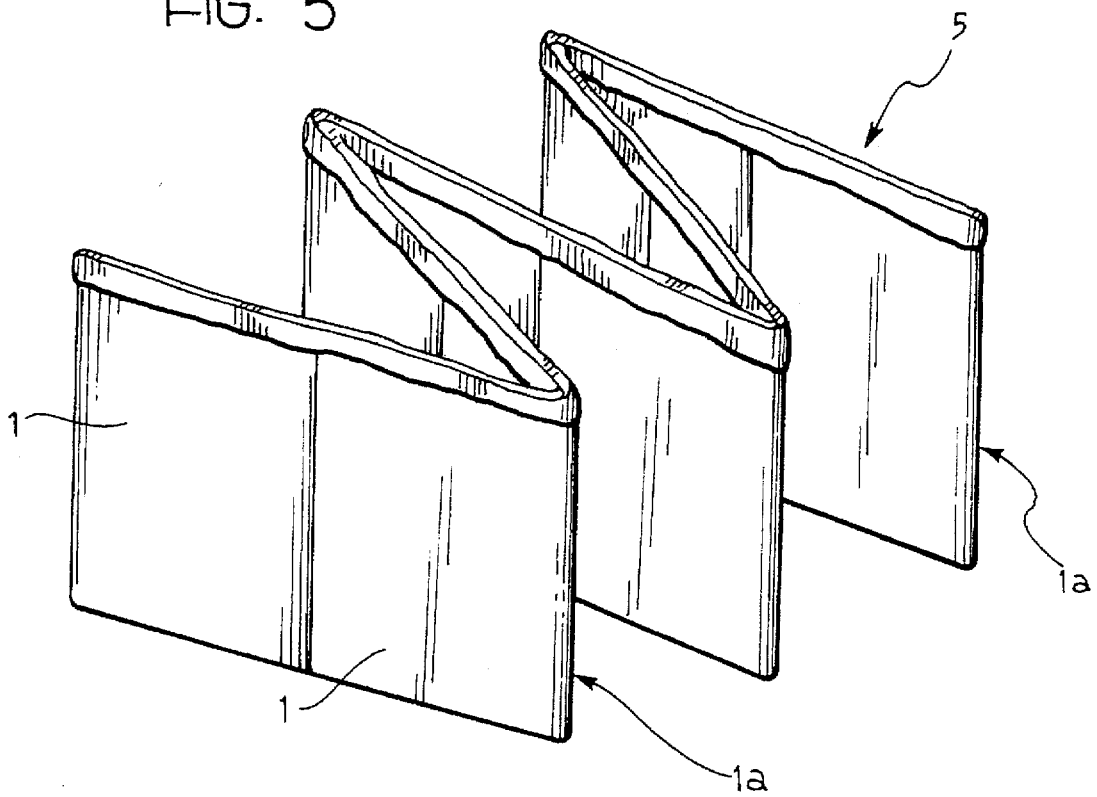
FIG. 5 is a perspective view of the structure of FIGS. 3 and 4 in another folding phase.

The flattened structure of FIG. 4 is then folded in a bellows-like manner, as illustrated in FIG. 5, by alternating a rotation in the clockwise direction with a rotation in the anti-clockwise direction of the vertical sides 1*a* of groups of component parts 1 which, in the arrangement of FIG. 4, are positioned one on top of the other. In particular, depending on the width of each component part 1 and on the space available for transport, it is possible to provide an alternating fold every two component parts 1, as illustrated in FIG. 5, or every of a smaller or larger number of component parts.

Figure 6:
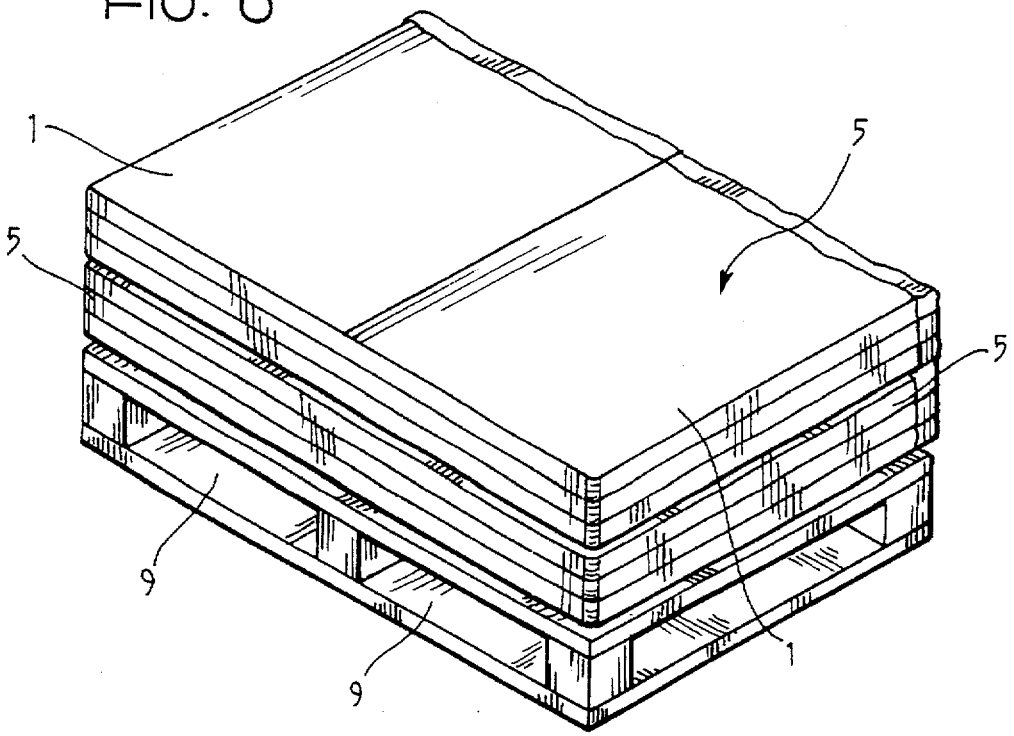
FIG. 6 is a perspective view of a group of structures according to the present innovation completely folded and ready for transport.

The completely folded multicellular structures can be placed on a loading platform 9, as illustrated in FIG. 6. In a borderline case, the space requirement, in plan view, of each completely folded multicellular structure 5 may be equal to the dimensions of a single component part 1. The covering sheet of geotextile is in practice completely contained within the folded multicellular structure 5 which, when it has to be used, can be rapidly unfolded and erected at the required site, ready to be filled with crushed stone or earth available in situ, without the intervention of specialised personnel being necessary.

The multicellular structure 5 thus unfolded is of substantial strength because the articulation joints between the sides 1*a* of the various component parts 1 are produced and checked at the time of manufacture, and mounting or assembly operations at the place of use are not necessary.

In an alternative embodiment, singularly folded C-shaped sub-groups 3 or groups thereof may be provided at the site where they can be unfolded and secured or joined in a cascade or chain manner so as to build a multicellular structure of any length which is a multiple of the width of each single component part. The last C-shaped sub-group of the chain may then, if desirable, be closed by a single component part constituting one of the end walls of the structure.

The presence of the internal compartments simplifies the filling operations because it is not necessary to have a high or uniform degree of compactness of the filling material along the entire extent of the multicellular structure.

In addition, because the multicellular structure 5 has neither a bottom nor a top, it is especially easy to remove it, for example when the emergency is over or for the transfer of the multicellular structure to another site, simply by lifting the structure by means of a crane or other heavy lifting means, the filling material being discharged from the lower portion.

Naturally, the principle of the innovation remaining the same, the forms of embodiment and details of construction, as well as the materials used, may vary widely without thereby departing from the scope of the innovation.

What is claimed is:

1. A foldable multicellular structure for rapid intervention works comprising two side flanks, two end walls articulated to the side flanks and a plurality of intermediate dividing walls articulated to the side flanks to define a plurality of compartments, said side flanks, end walls and dividing walls being formed by a netting, whereby the side flanks are formed by a plurality of component parts having at least one contiguous side, the component parts being articulated to one another along the at least one side, the end walls and the dividing walls each being formed by other component parts respectively, said structure being foldable into a first flattened arrangement in which the side flanks are disposed against each other and the end walls are adjacent to a portion of a respective side flank, wherein said first flattened arrangement is further foldable into a second flattened zig-zag arrangement upon being folded in alternating directions about common vertical sides of contiguous groups of contiguous component parts, each group including at least one component part of each side flank so that, in said second arrangement, the component parts of one group are superimposed on the component parts of a contiguous group in a zig-zag arrangement.

2. A foldable multicellular structure according to claim 1, wherein each group includes at least two contiguous component parts.

3. A multicellular structure according to claim 1, wherein the side flanks, the end walls and the dividing walls, defining said plurality of compartments, each have a layer of close-meshed material for lining each of said compartments.

4. A foldable multicellular structure according to claim 1, wherein said parts have substantially equal dimensions.

5. A foldable multicellular structure according to claim 4, wherein three component parts are assembled in C-shaped modular sub-groups which are connected to each other in a line to form a structure of predetermined length having a plurality of compartments, the length being a multiple of a width of each single component part.

* * * * *